US009318833B2

(12) United States Patent
Yagi et al.

(10) Patent No.: US 9,318,833 B2
(45) Date of Patent: Apr. 19, 2016

(54) CONNECTOR HOUSING

(71) Applicant: DAI-ICHI SEIKO CO., LTD., Kyoto (JP)

(72) Inventors: Sakai Yagi, Shizuoka (JP); Shuji Touno, Shizuoka (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 0 days.

(21) Appl. No.: 14/288,842

(22) Filed: May 28, 2014

(65) Prior Publication Data

US 2014/0364005 A1 Dec. 11, 2014

(30) Foreign Application Priority Data

Jun. 5, 2013 (JP) ..... 2013-119119

(51) Int. Cl.
*H01R 13/40* (2006.01)
*H01R 13/422* (2006.01)
*H01R 43/22* (2006.01)

(52) U.S. Cl.
CPC ..... *H01R 13/4223* (2013.01); *H01R 43/22* (2013.01)

(58) Field of Classification Search
CPC ..... H01R 13/4223
USPC ..... 439/595
See application file for complete search history.

(56) References Cited

U.S. PATENT DOCUMENTS 5,980,318 A * 11/1999 Morello ..... H01R 13/4226 439/595
6,764,335 B2 7/2004 Ichio
9,017,111 B2 * 4/2015 Zheng ..... H01R 13/4223 439/595
2003/0157834 A1 8/2003 Ichio
2004/0192109 A1 * 9/2004 Fukatsu ..... H01R 13/4223 439/595
2005/0009412 A1 1/2005 Kojima et al.
2012/0309219 A1 * 12/2012 Hiraishi ..... H01R 13/4365 439/352
2013/0295794 A1 * 11/2013 Nemoto ..... H01R 13/4226 439/595
2014/0193989 A1 * 7/2014 Kutsuna ..... H01R 13/4226 439/155

FOREIGN PATENT DOCUMENTS

EP 2 530 787 12/2012
JP 7-282883 10/1995
JP 2003-243078 8/2003

(Continued)

OTHER PUBLICATIONS

The extended European search report issued Oct. 14, 2014 in corresponding European patent application No. 14169988.4.

*Primary Examiner* — Abdullah Riyami
*Assistant Examiner* — Thang Nguyen
(74) *Attorney, Agent, or Firm* — Wenderoth, Lind & Ponack, L.L.P.

(57) ABSTRACT

A housing used for an electric connector, includes a terminal space into which an electric terminal is to be inserted, and a lance for preventing the electric terminal from being slipped out of the terminal space. The lance includes a flexible portion, and a protrusion extending from the flexible portion and engaging with the electric terminal. The lance defines an escape space in which the flexible portion can be bent in a direction in which the protrusion and the electric terminal are disengaged with each other. The flexible portion has a passage along which a jig can move and which extends in a direction in which the jig is inserted into the lance, and the jig is used for disengaging the protrusion and the electric terminal from each other.

12 Claims, 18 Drawing Sheets

(56) References Cited

FOREIGN PATENT DOCUMENTS

| | | | | | |
|---|---|---|---|---|---|
| JP | 2003-297473 | 10/2003 | | | |
| JP | 2003297473 | A | * | 10/2003 | ..... H01R 13/42 |
| JP | 2005-19282 | | | 1/2005 | |
| WO | 2012/095934 | | | 7/2012 | |
| WO | 2013/042376 | | | 3/2013 | |

* cited by examiner

CONNECTOR HOUSING

BACKGROUND OF THE INVENTION

1. Field of the Invention

The invention relates to a housing of an electric connector having a terminal space into which an electrically conductive terminal to which a cable is connected is inserted.

2. Description of the Related Art

A female terminal or an electrically conductive terminal connected at a proximal end thereof to a cable is inserted into a terminal space formed in a housing of an electric connector. In order to prevent the female terminal from being slipped out of the terminal space, the terminal space is generally designed to include a lance at a wall thereof to be engaged with a recess of the female terminal.

However, when the female terminal is inserted into an incorrect terminal space, the female terminal has to be pulled out of the terminal space, and be inserted into a correct terminal space. Accordingly, it is necessary to disengage the lance and the recess of the female terminal from each other.

Japanese Patent Application Publications Nos. H7(1995)-282883 and 2003-243078 have suggested the disengagement of the lance and the recess of the female terminal from each other.

FIG. 19 is a perspective view of the connector housing suggested in Japanese Patent Application Publication No. H7(1995)-282883.

The illustrated connector housing 1000 includes a housing 1008 having a terminal space 1002 into which a terminal 1001 is inserted, and flexible lock 1004 arranged in the terminal space 1002. The flexible lock 1004 divides the terminal space 1002 into an upper space and a lower space 1005, and is designed to include in the upper space a protrusion 1003 to be engaged with the terminal 1001 having been inserted into the terminal space 1002. The flexible lock 1004 can be bent into the lower space 1005. The flexible lock 1004 is formed in the lower space 1005 with a protrusion 1007. The flexible lock 1004 is bent in a direction in which the protrusion 1003 and the terminal 1001 are disengaged from each other, by engaging the protrusion 1007 to a jig inserted into the lower space 1005 through an opening 1006.

FIG. 20 is a perspective view of the connector suggested in Japanese Patent Application Publication No. 2003-243078.

The illustrated connector 1100 includes a lance 1101 having a front end acting as a stopper 1102 for preventing a female terminal from slipping out of the connector. The connector 1100 includes, adjacent to the stopper 1102, a wedge 1103 along which a jig slides. By causing a jig to slide along the wedge 1103, the lance 1101 is resiliently bent to thereby allow the stopper 1102 to slip out of the female terminal.

In the connector housing 1000 illustrated in FIG. 19, the protrusion 1007 is downwardly pushed to thereby deform the flexible lock 1004 in a direction in which the terminal 1001 and the connector housing 1000 are disengaged from each other. However, since the protrusion 1007 protrudes in the space 1005, the space 1005 has to be sufficiently large to allow the protrusion 1007 to move therein, resulting in that the housing 1008 cannot avoid being large.

In the connector 1100 illustrated in FIG. 20, since the wedge 1103 is situated adjacent to the stopper 1102 formed at a front end of the lance 1101, the lance 1101 has to be formed wide. Furthermore, it is necessary to form an opening through which a jig is inserted into the connector 1100, and a space in which the inserted jig goes forward, in a terminal space in which a terminal is housed, resulting in that the a housing of the connector 1100 has to be formed large.

SUMMARY OF THE INVENTION

In view of the above-mentioned problems in the related art, it is an object of the present invention to provide a housing of an electric connector, which is able to surely disengage from a female terminal through the use of a jig, and further, is able to be formed down-sized.

In one aspect of the present invention, there is provided a housing used for an electric connector, including at least one terminal space into which an electric terminal is to be inserted, and a lance for preventing the electric terminal from being slipped out of the terminal space, the lance including a flexible portion, and a protrusion extending from the flexible portion and engaging with the electric terminal, the lance defining an escape space in which the flexible portion can be bent in a direction in which the protrusion and the electric terminal are disengaged with each other, the flexible portion having a passage along which a jig can move and which extends in a direction in which the jig is inserted into the lance, the jig being used for disengaging the protrusion and the electric terminal from each other.

In the housing in accordance with the present invention, the flexible portion is designed to have a passage along which a jig used for disengaging the protrusion and the electric terminal from each other can move and which extends in a direction in which the jig is inserted into the lance. Thus, it is possible to engage the jig to the flexible portion without increasing an entire height of the lance. Accordingly, since a space required to the housing as the escape space is just a space in which the flexible portion is able to deform so as to disengage from the protrusion, resulting in that, in comparison with the conventional connector housing 1000 illustrated in FIG. 19, it is no longer necessary to have a space in which the protrusion 1007 can move.

For instance, the passage may comprise a recess, in which case, it is preferable that the recess is formed at opposite sidewalls of the flexible portion, in particular, at edges of the opposite sidewalls.

For instance, the recess may be formed by chipping opposite sidewalls of the flexible portion. A jig inserted into the housing is housed along the recess formed at a sidewall of the flexible portion. Furthermore, since the recess can be formed along a sidewall of the flexible portion, it is possible to design the recess to have a length sufficient to hold a jig therealong.

For instance, the lance may be designed to include two flexible portions extending in parallel with each other, the protrusion outwardly extending from each of the flexible portions, and the escape space being defined between the flexible portions.

It is preferable that a pair of the recesses is formed at opposite sidewalls of the flexible portion to thereby form a raised portion on a wall of the flexible portion, and a pair of engaging portions formed at a distal end of the jig moves to thereby sandwich the raised portion therebetween.

A pair of engaging portions formed at a distal end of the jig can be engaged to the recesses. Hence, it is possible to cause the flexible portion to be bent in the escape space by moving the jig in a direction in which the housing and the female terminal are disengaged from each other.

It is preferable that the recess has an inclined surface having a depth shallower in a direction in which the jig disengages the protrusion and the electric terminal from each other. Since a wall located in the direction can be formed thick, the wall on which a stress acts when a jig moves in the direction can have an enhanced strength.

It is preferable that the recess extends to the protrusion from a distal end of the flexible portion. Since a distal end of a jig reaches at the protrusion when the jig is inserted into the housing, it is possible to disengage the electric terminal and the protrusion from each other merely by moving the jig at a distal end thereof in the above-mentioned direction.

The recess may be designed to extend to the protrusion from a location away from a distal end of the flexible portion.

It is preferable that the flexible portion has a constant thickness from an end to the other end in a direction in which the protrusion and the electric terminal are disengaged with each other. Even if the flexible portion were chipped for forming the recess, since the flexible portion is designed to have a constant thickness from an end to the other end in the above-mentioned direction, it would be possible to avoid reduction of a strength of the flexible portion.

It is preferable that the flexible portion is defined by a wall of the terminal space. By defining the flexible portion with a wall of the terminal space, it is no longer necessary to form a wall of the terminal space, ensuring that the housing can be down-sized.

For instance, the passage may comprise a through-hole. The advantages obtained by the aforementioned present invention will be described hereinbelow.

The housing in accordance with the present invention makes it possible to engage the jig to the flexible portion without increasing an entire height of the lance. Accordingly, since a space required to the housing as the escape space is just a space in which the flexible portion is able to deform so as to disengage from the protrusion, resulting in that the electric terminal and the housing can be surely disengaged from each other, and the housing can be down-sized.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Preferred embodiment in accordance with the present invention will be explained hereinbelow with reference to drawings.

Figure 1:
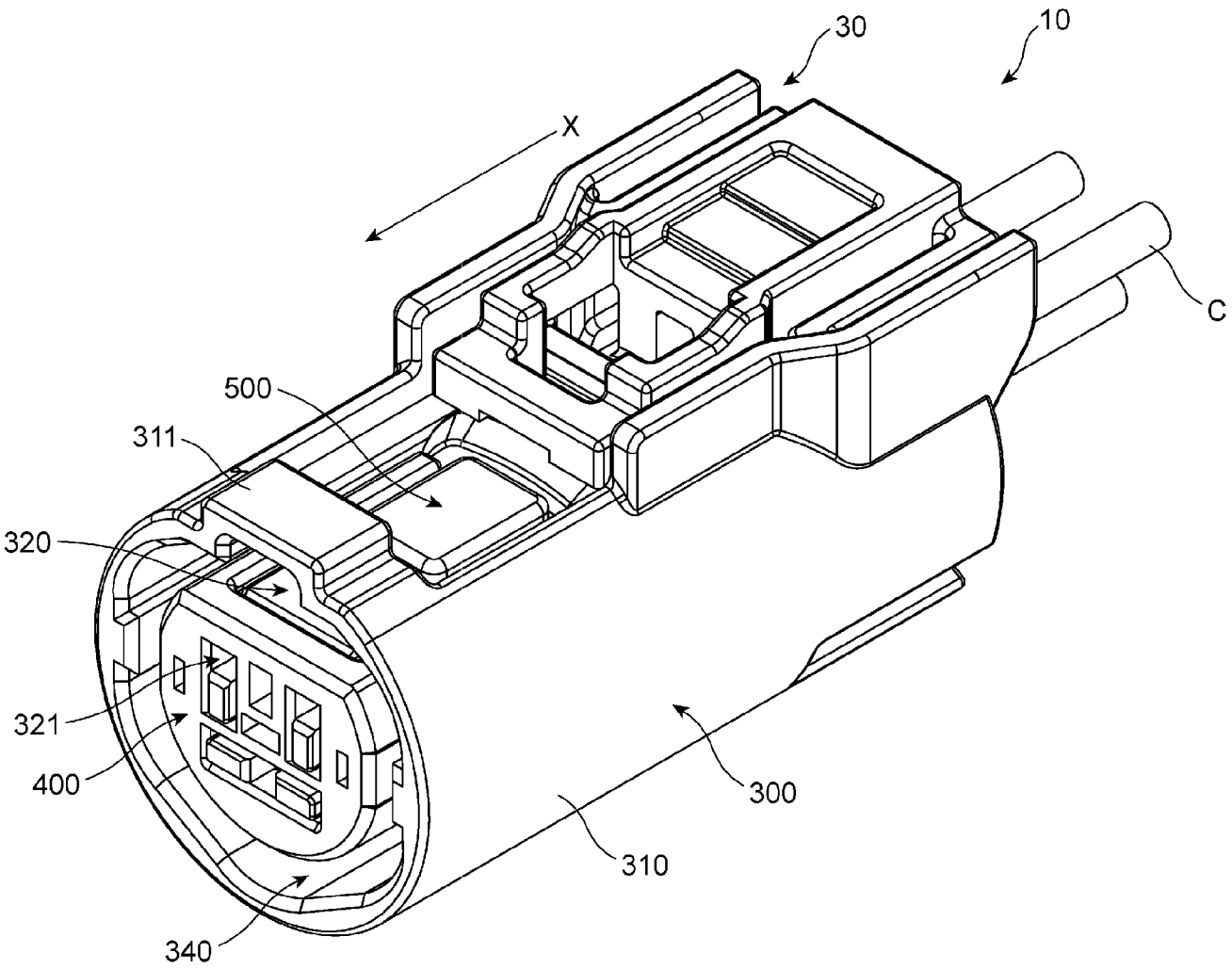
FIG. 1 is a front perspective view of the electric connector in accordance with a preferred embodiment of the present invention.

An electric connector 10 illustrated in FIG. 1 comprises a three-terminal type female connector into which a male electric connector having needle-shaped male terminals is inserted. The electric connector 10 is employed for signal transmission in various sensors.

As illustrated in FIGS. 1 to 4, the electric connector 10 includes a female terminal 20 acting as an electrically conductive terminal into which a male terminal is inserted, and a molded housing 30.

Figure 4:
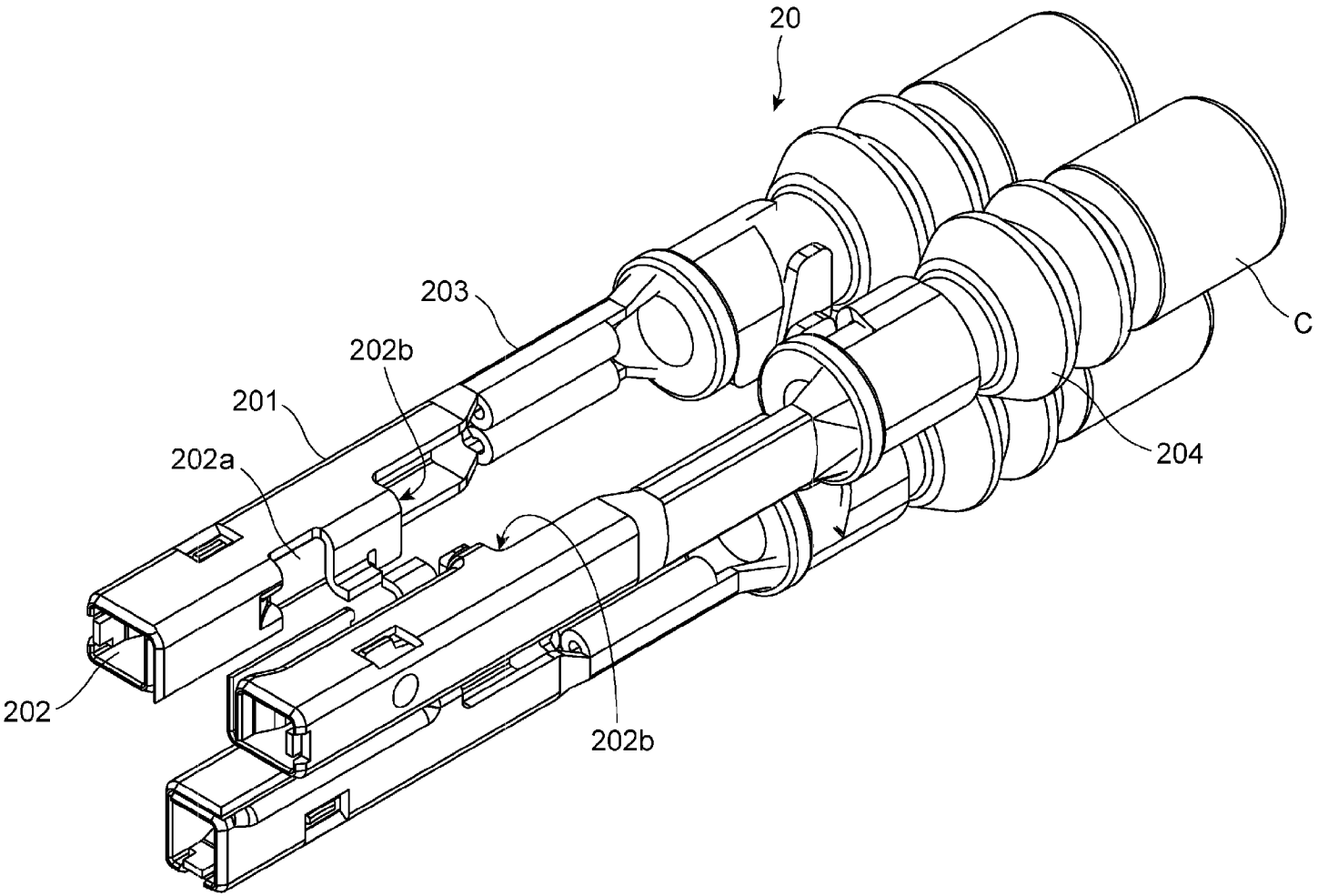
FIG. 4 is a perspective view of a female terminal of the electric connector illustrated in FIG. 1.

As illustrated in FIG. 4, the female terminal 20 includes an electrically conductive sheath 201 to be inserted into the housing 30, a resilient contact piece 202 formed in the sheath 201 in electrical communication with the sheath 201, a bundler 203 formed at a rear of the sheath 201 for fixing a cable C in a compressed condition, and a water-proof cap 204 formed at a rear of the bundler 203 and into which the cable C is inserted. The sheath 201 has a rectangular cross-section, and the resilient contact piece 202 and the bundler 203 are integrally formed by bending a metal plate having sufficient electrical conductivity. It should be noted that the resilient contact piece 202 and the sheath 201 are formed as separate parts from each other in the present embodiment.

The sheath 201 is formed with a first stepped portion 202*a* defining a recess to which a later-mentioned lance is engaged so as to prevent the female terminal 20 being slipped out of the housing 30. The sheath 201 is formed at a rear end thereof further with a second stepped portion 202*b* in order to prevent the female terminal 20 from being slipped out of the housing 30 through the use of a later-mentioned rear holder.

In the specification, a direction in which the female terminal 20 is inserted into the housing 30, that is, a direction indicated with an arrow X shown in FIG. 1 indicates a front, and the opposite direction indicates a rear.

Figure 2:
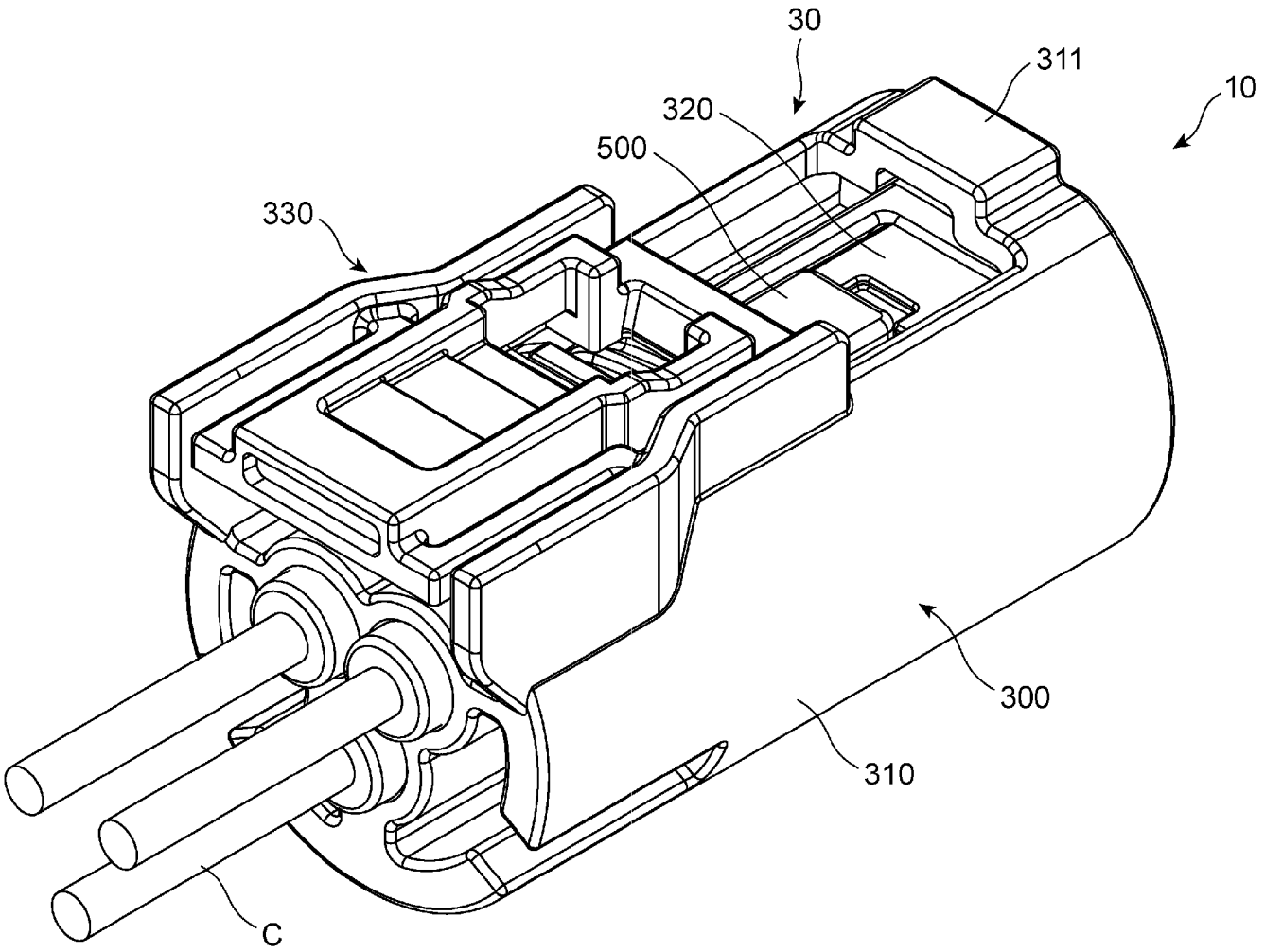
FIG. 2 is a rear perspective view of the electric connector illustrated in FIG. 1.
Figure 3:
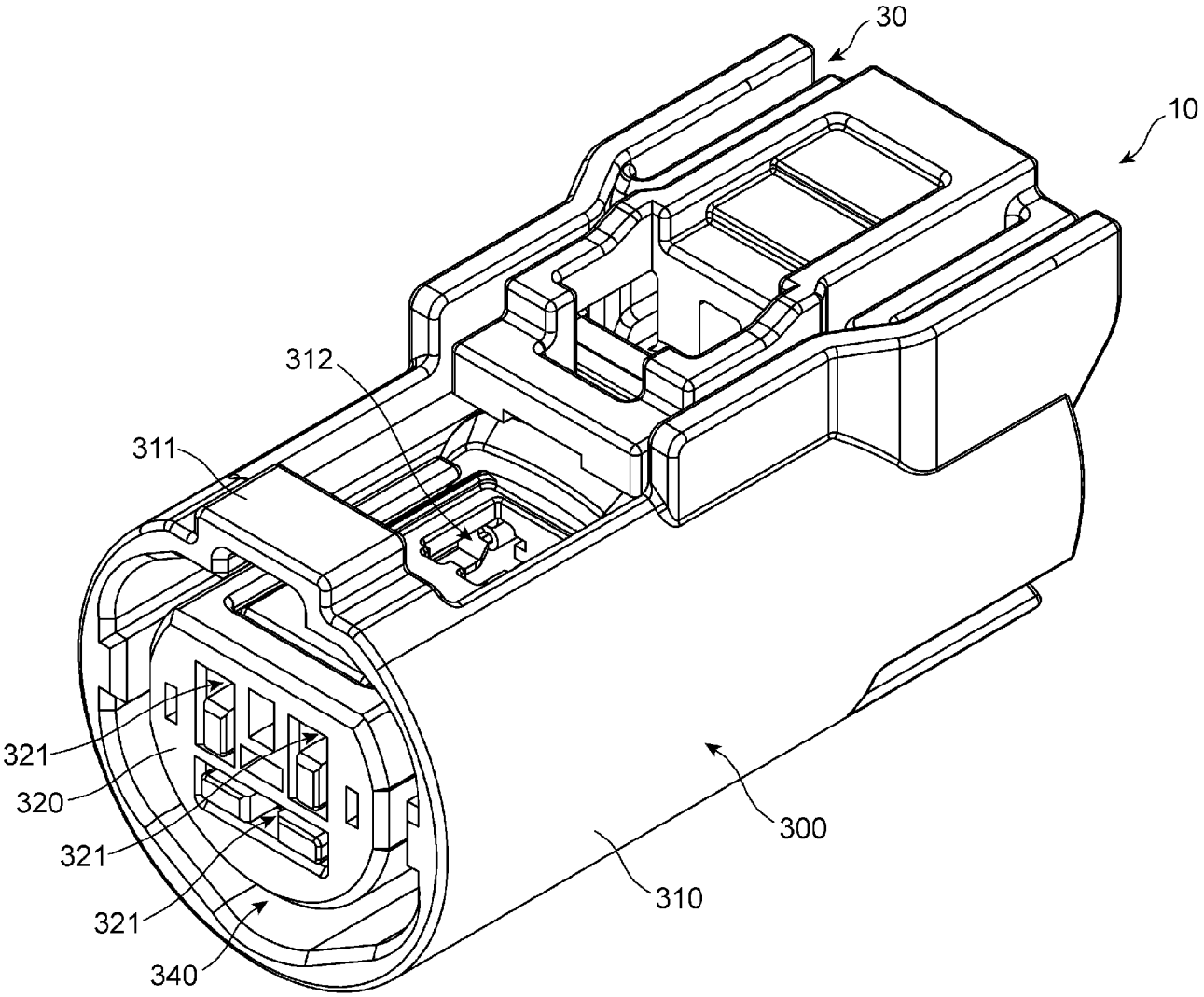
FIG. 3 is a front perspective view of the electric connector illustrated in FIG. 1 with a rear holder being taken off.

As illustrated in FIGS. 1 to 3, the housing 30 includes a housing body 300, a front holder 400, and a rear holder 500.

The housing body 300 includes a cylindrical portion 310, and a space 320 in which the female terminals 20 are arranged.

The cylindrical portion 310 is formed with a receiver 311 in which a protrusion formed at a front end of a housing of the male electric connector is received. The receiver 311 is formed by radially extending a portion of an outer wall of the cylindrical portion 310.

Figure 9:
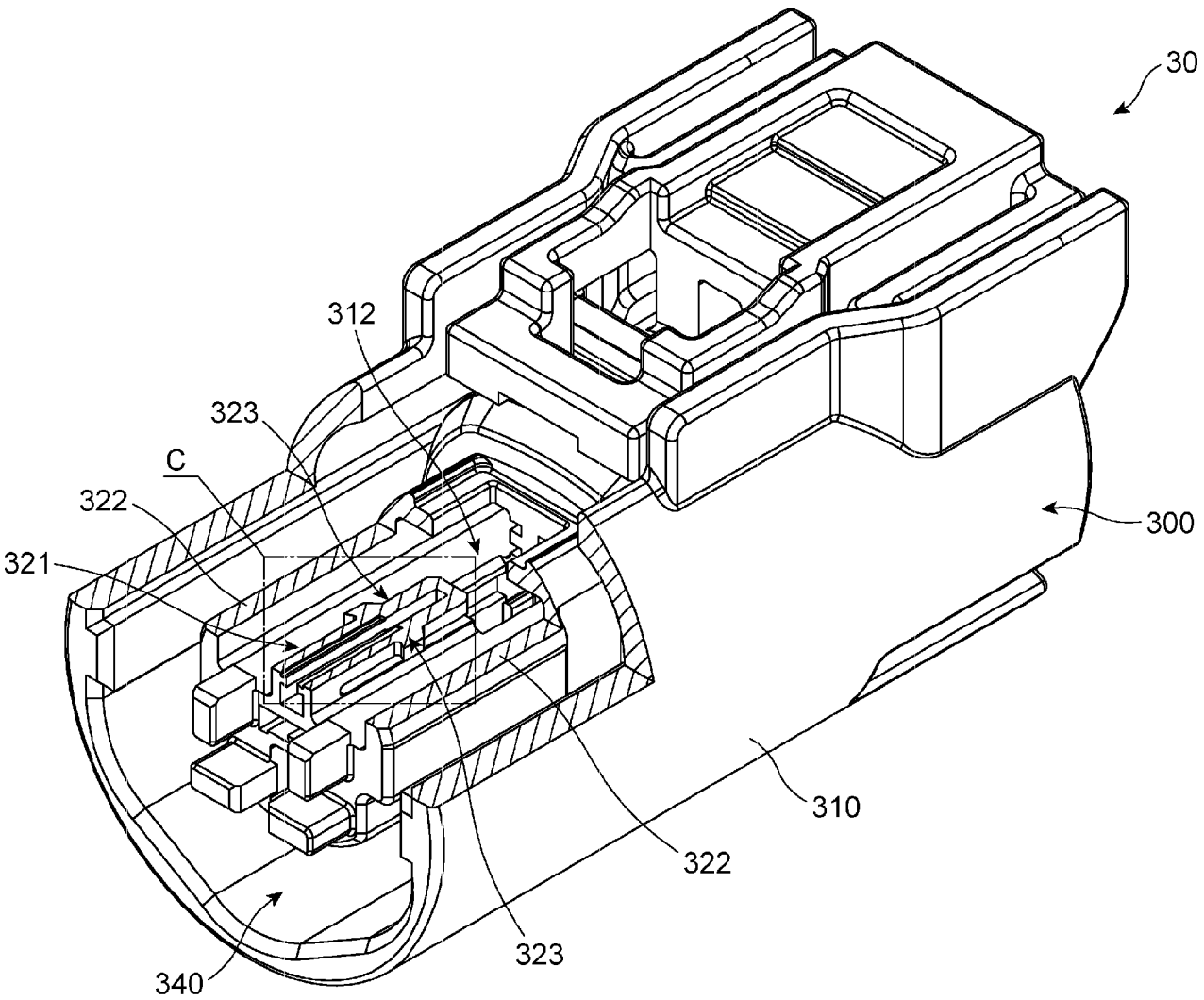
FIG. 9 is a partially cross-sectional, front perspective view of the electric connector illustrated in FIG. 1 with both a front holder and a female terminal being taken off.

The cylindrical portion 310 is formed at an upper portion thereof with an opening 312 through which the rear holder 500 is inserted at a rear of the space 320 (see FIGS. 3 and 9).

Between the cylindrical portion 310 and the space 320 is formed a space 340 into which a housing of the male electric connector is inserted.

Figure 5:
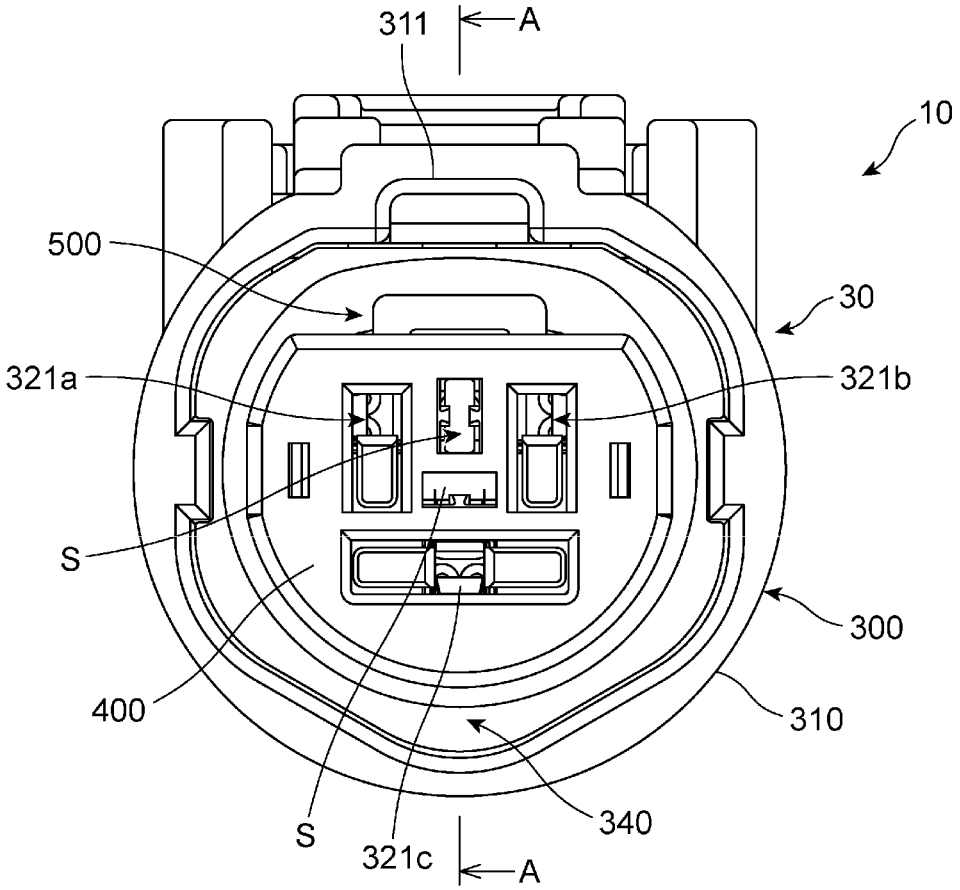
FIG. 5 is a front view of the electric connector illustrated in FIG. 1.

Three terminal spaces 321 are arranged in the space 320 such that the terminal spaces 321 are located at apexes of a triangle around an axis of the space 320. As illustrated in FIG. 5, the three terminal spaces 321 comprise terminal spaces 321*a*, 321*b* and 321*c*. The terminal spaces 321*a* and 321*b* are situated in the space 320 such that their first stepped portions 202*a* face each other, and the terminal space 321*c* is situated in the space 320 such that the first stepped portion 202*a* thereof faces the terminal spaces 321*a* and 321*b*.

Figure 8:
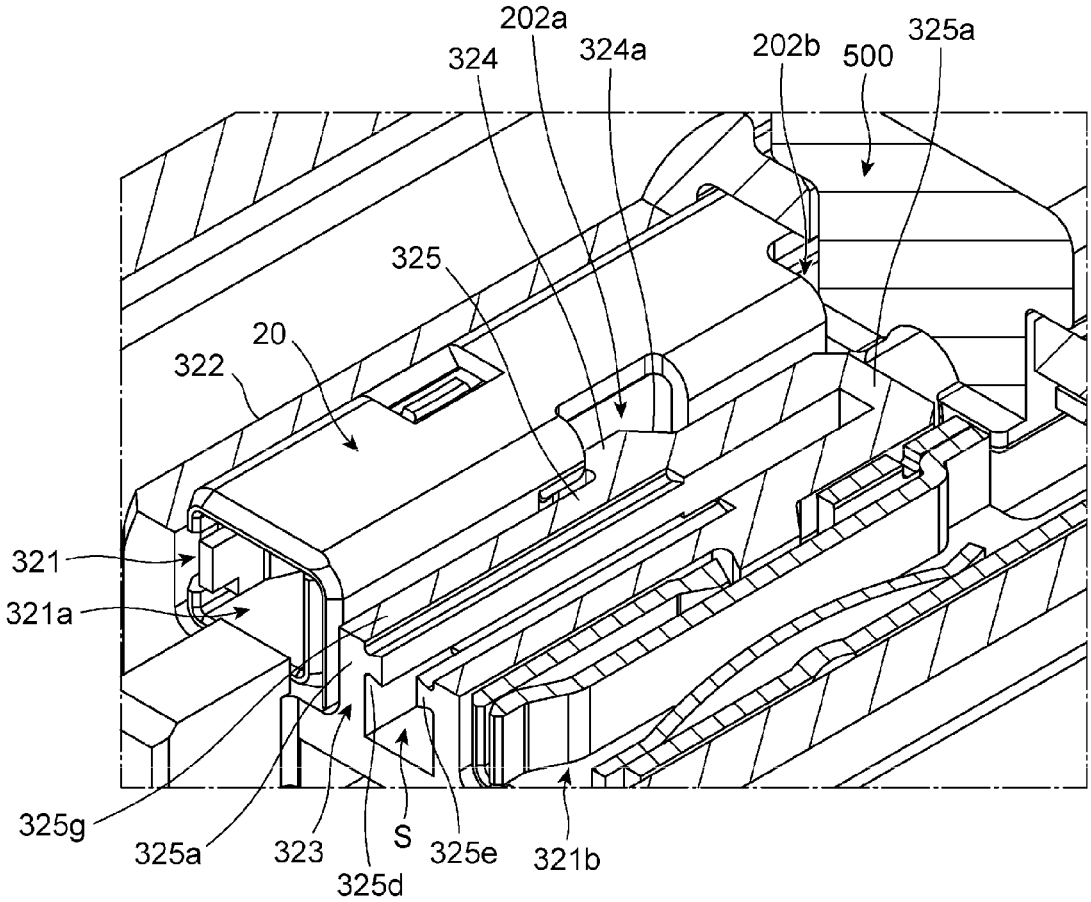
FIG. 8 is an enlarged view of the part B shown in FIG. 7.
Figure 10:
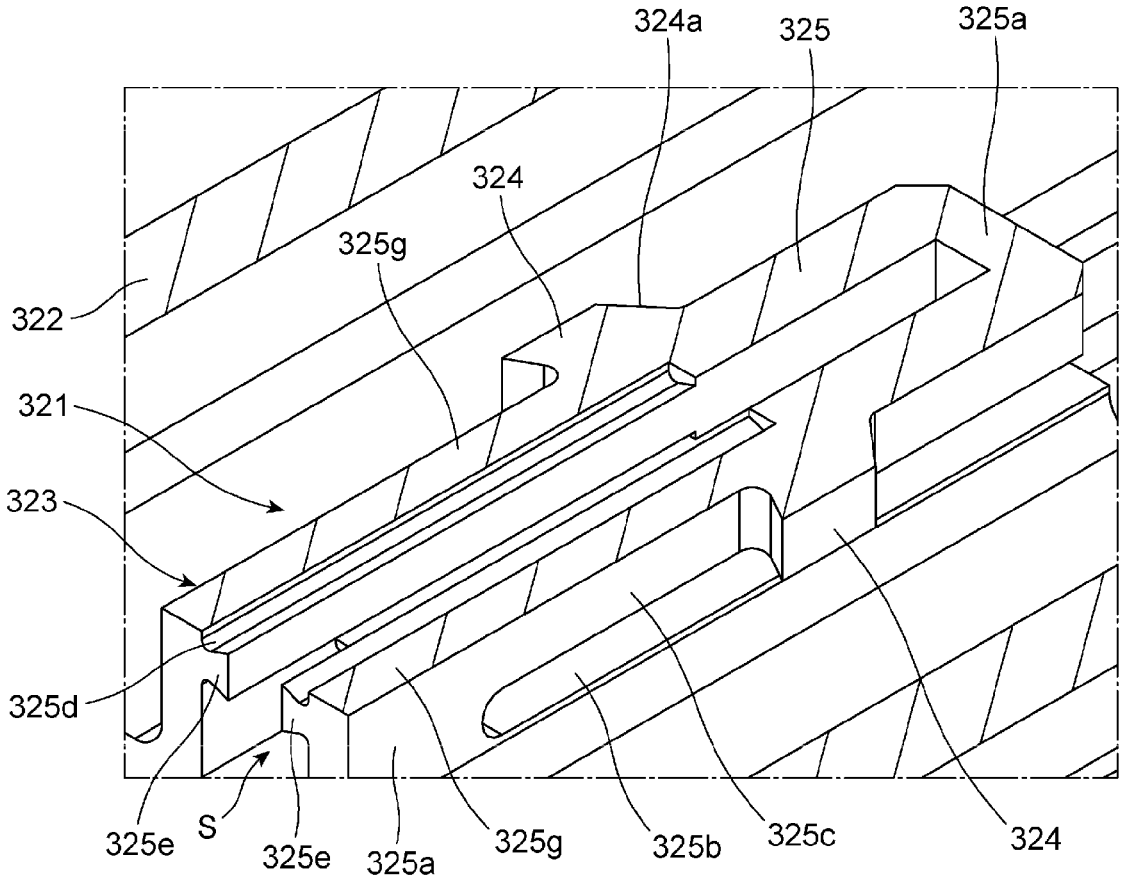
FIG. 10 is an enlarged view of the part C shown in FIG. 9.
Figure 11:
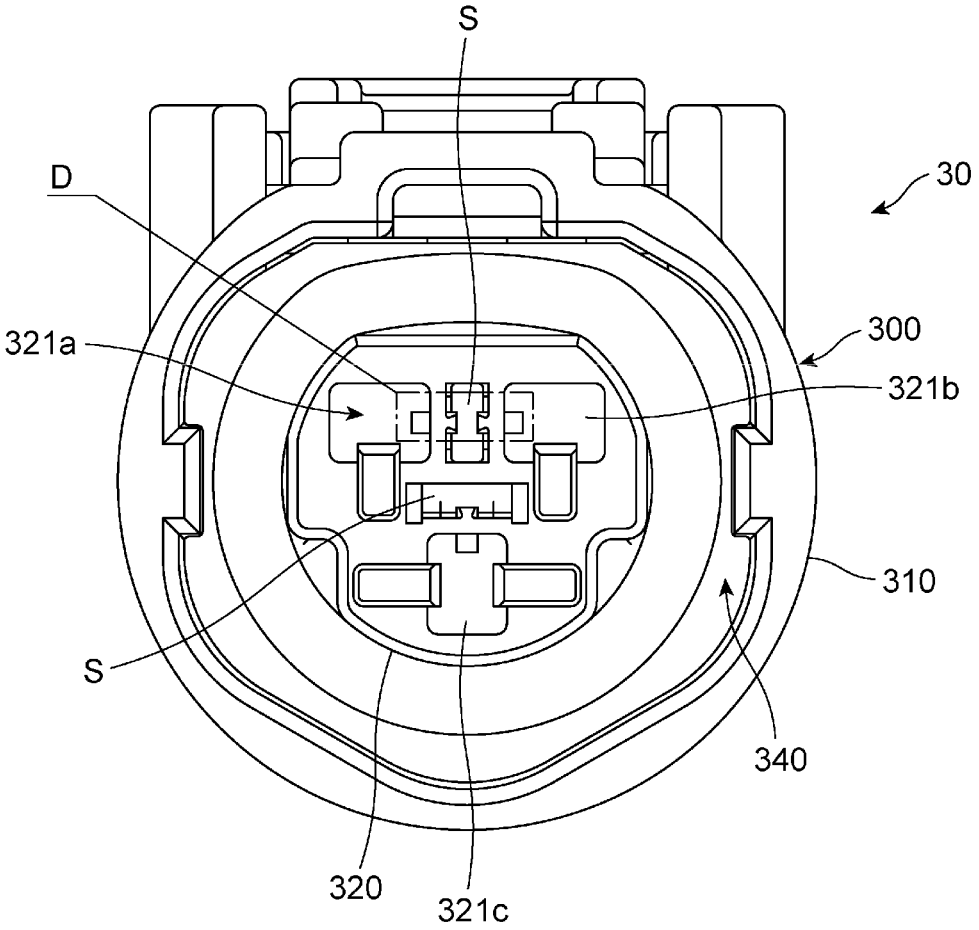
FIG. 11 is a front view of the electric connector illustrated in FIG. 9.

As illustrated in FIGS. 8 and 10, each of the terminal spaces 321*a* to 321*c* is formed rectangular in accordance with an outer shape of the sheath 201 having a rectangular cross-section in a width-wise direction. Each of the terminal spaces 321*a* to 321*c* is surrounded with three fixed walls 322 and a lance 323.

There is formed an escape space S between the terminal spaces 321*a* and 321*b* and above the terminal space 321*c*. The lance 323 is designed to be bent into the escape space S. Hereinbelow is explained the lance 323.

The lance 323 prevents the female terminal 20 having been inserted into the terminal space 321 from being slipped out of the terminal space 321. As illustrated in FIG. 10, the lance 323 includes two protrusions 324 each being engaged to the first stepped portion 202*a* when the female terminal 20 is pulled out of the housing 30, and two resilient (flexible) portions 325 from which each of the protrusions 324 protrudes.

Each of the protrusions 324 is trapezoidal and has a pair of edges which are not in parallel with each other and are inclined towards the front. Each of the resilient portions 325 is formed with a slit 325*b* between fixed portions 325*a* formed integral at opposite ends thereof with the fixed walls 322, and has a movable portion 325*c* which is movable by virtue of the slit 325*b*.

Each of the flexible (resilient) portions 325 is formed at edges thereof with recesses 325*d* along which a jig is inserted through the front of the housing 30. The recesses 325*d* are formed by chipping opposite sidewalls 325*g* of the flexible portion 325, and extend in a direction in which a jig is inserted into the housing 30. In the present embodiment, each of the recesses 325*d* is formed as a linear groove by linearly chipping the opposite sidewalls 325*g* of the flexible portion 325 in a direction in which a jig is inserted into the housing 30. By chipping the opposite sidewalls 325*g* of the flexible portion 325, a protrusion (raised portion) 325*e* is formed between the recesses 325*d*. The protrusion 325*e* linearly extends in a direction in which a jig is inserted into the housing 30.

Each of the recesses 325*d* extends to the protrusion 324 of the movable portion 325*c* from the fixed portion 325*a* located at the front end. A width of a top of the protrusion 325*e* can be any length in accordance with how much the flexible portion 325 is chipped.

Figure 12:
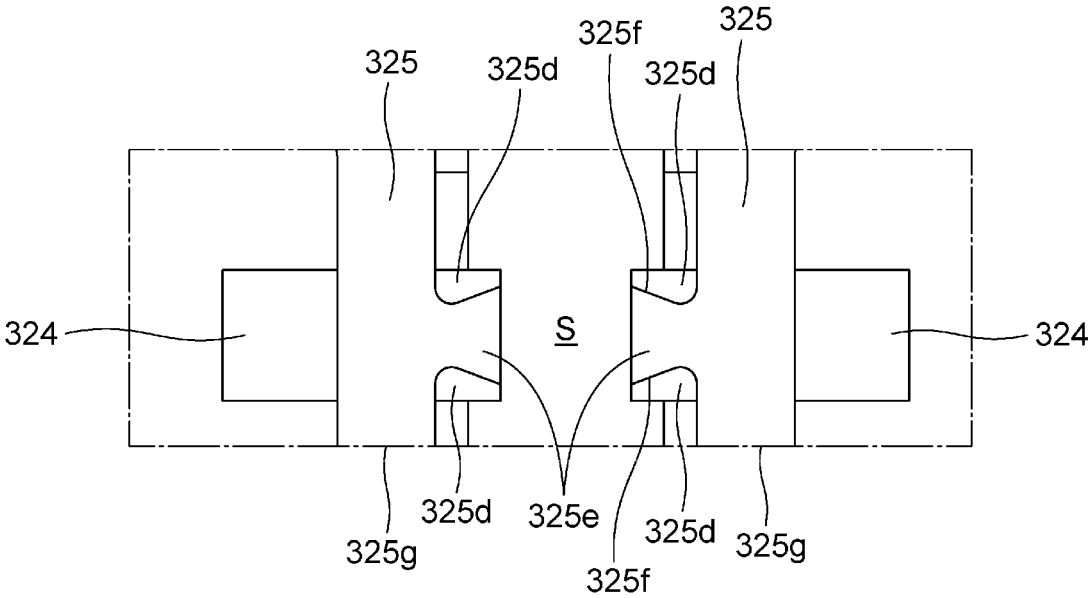
FIG. 12 is an enlarged view of the part D shown in FIG. 11.

As illustrated in FIG. 12, each of the recesses 325*d* is designed to be tapered. Specifically, each of the recesses 325*d* has an inclined surface 325*f* shallower towards the opposing protrusion 325*e*.

As illustrated in FIGS. 1 and 3, the front holder 400 is attached to a front of the space 320 in order to prevent the female terminal 20 from being overpushed. The front holder 400 has a circular cross-section, and is formed with openings at locations in alignment with each of the terminal spaces 321*a* to 321*c* into each of which a terminal pin of the male electric connector is inserted.

Figure 13:
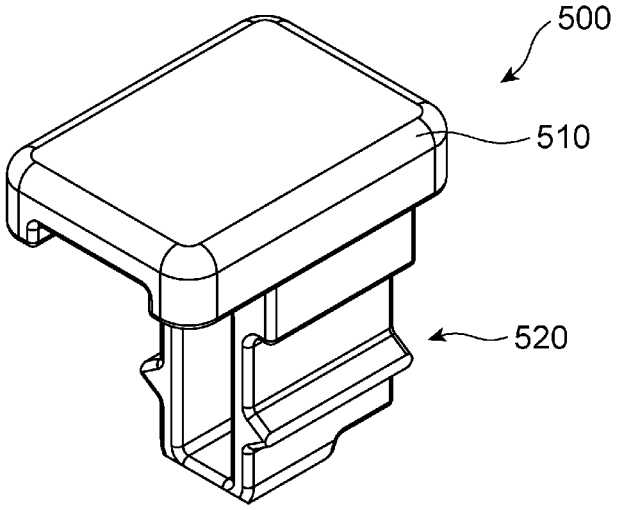
FIG. 13 is a perspective view of a rear holder of the electric connector illustrated in FIG. 1.

As illustrated in FIG. 13, the rear holder 500 includes a rectangular top 510, and a leg 520 downwardly extending from the top 510 and being hollow inside. The rear holder 500 is inserted into the housing body 300 through an opening formed at an upper portion of the housing body 300 such that the leg 520 is inserted into a space formed between the second stepped portions 202*b* of the female terminals 20 arranged facing each other, and is engaged to the second stepped portions 202*b* of the female terminals 20.

The electric connector 10 in accordance with the preferred embodiment of the present invention, having the above-mentioned structure, is used as follows.

Figure 6:
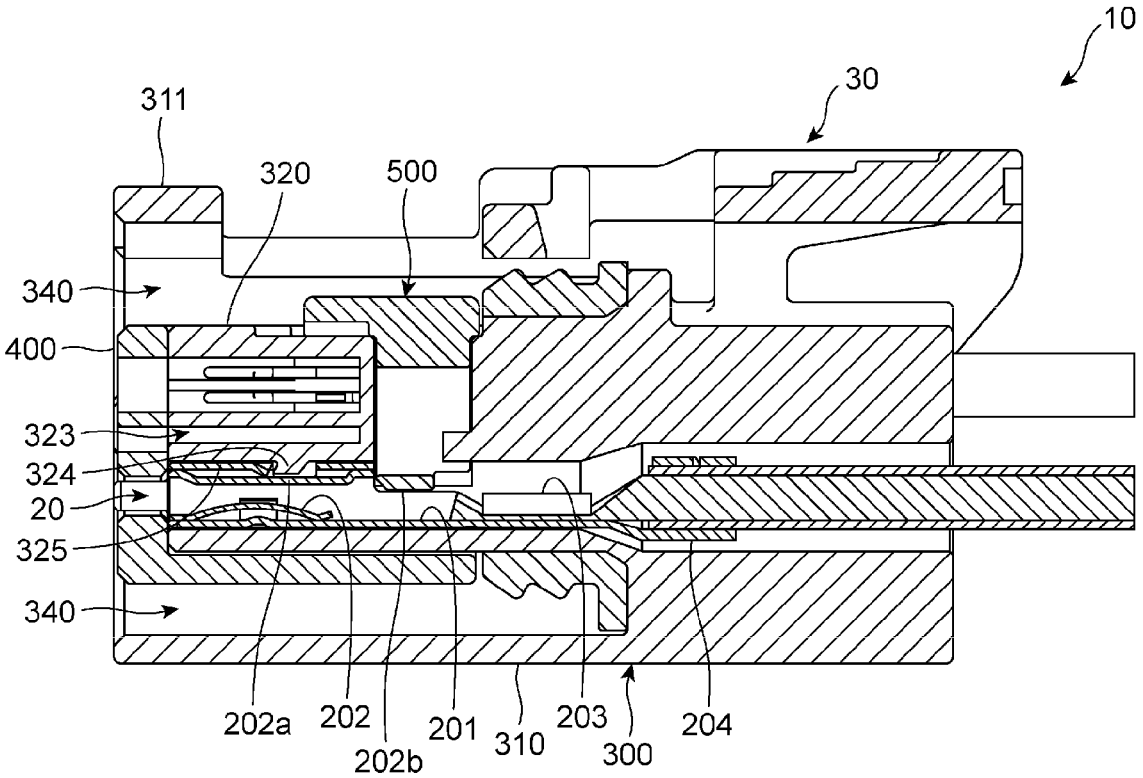
FIG. 6 is a cross-sectional view taken along the line A-A shown in FIG. 5.

As illustrated in FIGS. 5 and 6, the three female terminals 20 in each of which core wires of the cable C are fixed in the bundler 203 in a compressed condition are inserted into the terminal spaces 321*a* to 321*c* through a rear of the terminals rooms 321*a* to 321*c* such that the first stepped portion 202*a* of each of the female terminals 20 is directed towards an axis of the housing body 300.

Inserting the female terminal 20 into each of the terminal spaces 321*a* to 321*c*, the sheath 201 of the female terminal 20 is engaged at a front end thereof to the protrusion 324 of the lance 323. By intensively inserting the female terminal 20 into each of the terminal spaces 321*a* to 321*c*, the protrusion 324 is pushed. Thus, the movable portion 325*c* of the flexible portion 325 is resiliently bent arcuate to thereby escape into the escape space S (see FIG. 8). Thus, the sheath 201 forwardly slides on the inclined surface 324*a* of the protrusion 324. When a front end of the female terminal 20 arrives at a front end of each of the terminal spaces 321*a* to 321*c*, the stepped portion 202*a* passes over the protrusion 324. Thus, the movable portion 325*c* resiliently returns back to an initial position to thereby cause the protrusion 324 to be engaged to the first stepped portion 202*a*. Consequently, since the first stepped portion 202*a* is engaged to the protrusion 324, the female terminal 20 cannot be slipped out of each of the terminal spaces 321*a* to 321*c*.

Figure 7:
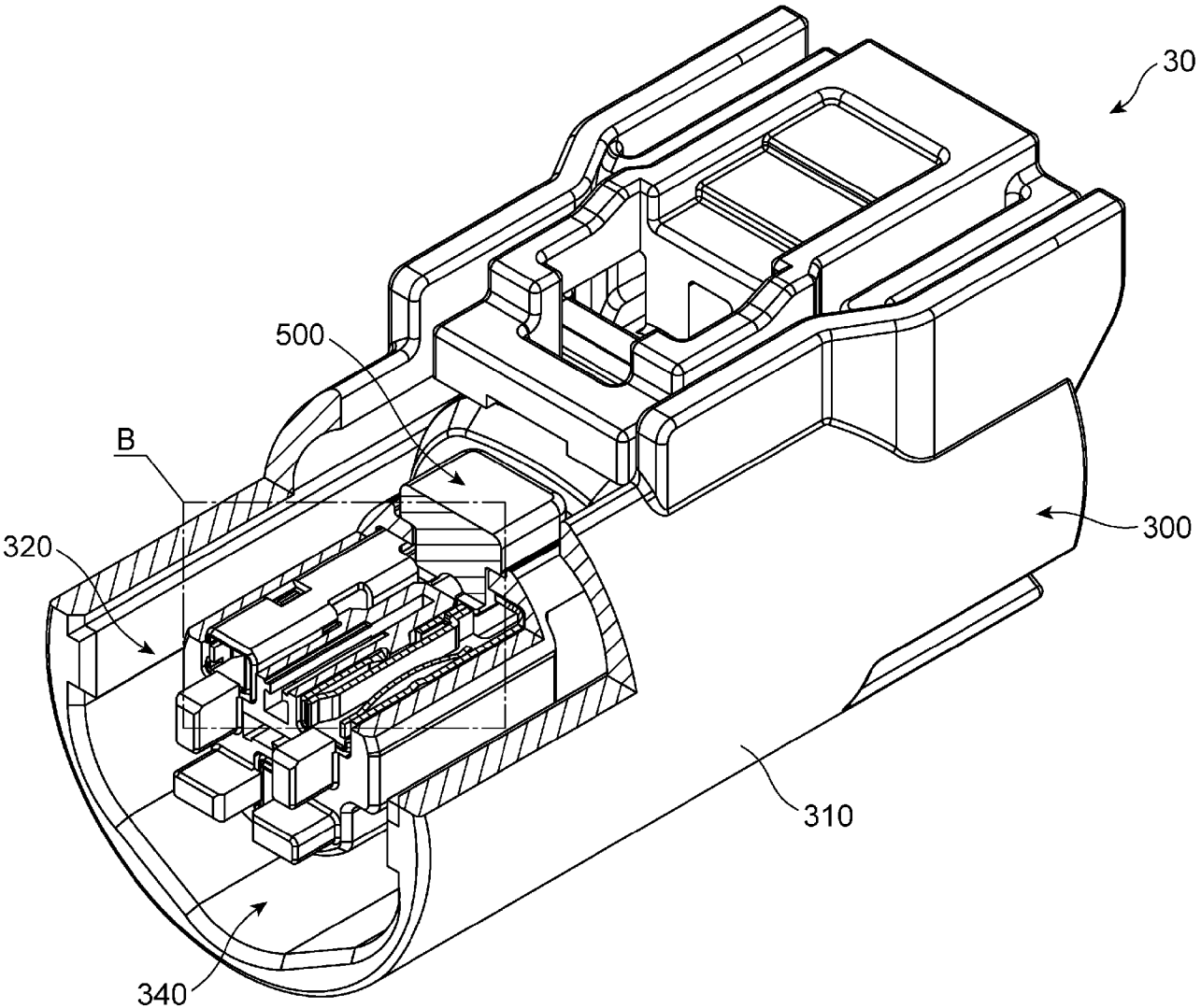
FIG. 7 is a partially cross-sectional, front perspective view of the electric connector illustrated in FIG. 1 with a front holder being taken off.

After the female terminal 20 has been inserted into the housing 30, the rear holder 500 is inserted into the opening 312 of the housing body 300. FIG. 9 illustrates the housing body 300 into which the rear holder 500 is not yet inserted, and FIG. 7 illustrates the housing body 300 into which the rear holder 500 is inserted. Inserting the rear holder 500 into the housing body 300 through the opening 312, the female terminal 20 cannot be pulled out of the housing body 300, even if the female terminal 20 is pulled, because the second stepped portion 202*b* is engaged to the leg 520 of the rear holder 500. Consequently, it is possible to doubly prevent the female terminal 20 from being slipped out of the housing body 300 by virtue of both the protrusion 324 of the lance 323 and the rear holder 500.

Hereinbelow is explained how the female terminal 20 is pulled out of the housing body 300.

In order to pull the female terminal 20 out of the housing body 300, there is used a jig having a function of releasing the engagement of the lance 323 to the female terminal 20. Hereinbelow is explained the jig with reference to the drawings.

Figure 14:
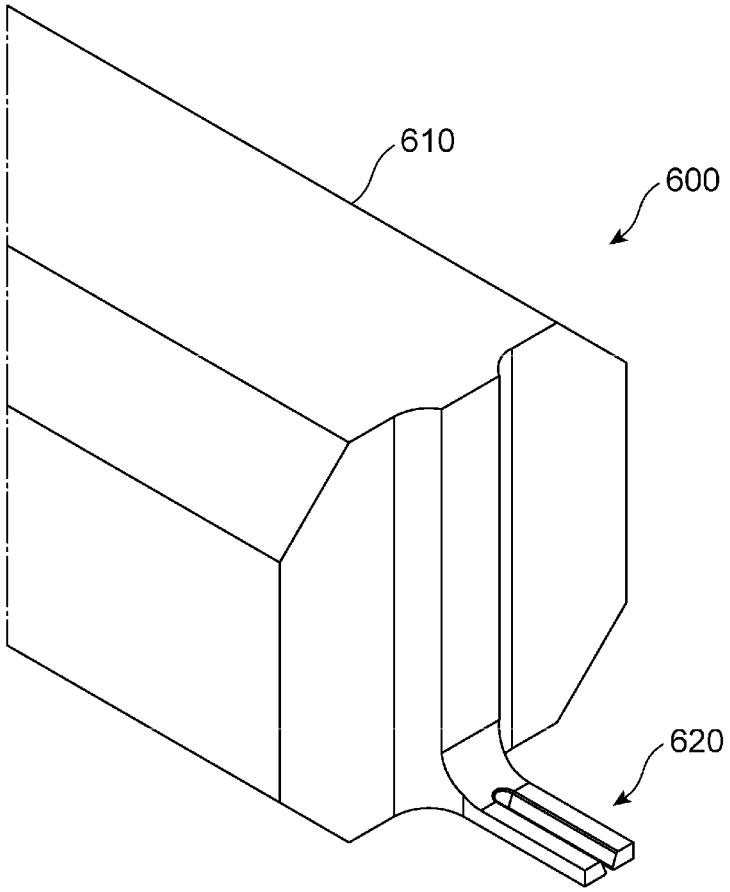
FIG. 14 is a perspective view of a distal end of a jig used for disengaging a female terminal and the housing from each other.

A jig 600 illustrated in FIG. 14 is composed of metal. The jig 600 includes a handle 610 having an octagonal cross-section in the form of a bar, and a pair of engagement portions 620 extending from a front end of the handle 610 in parallel with each other. Each of the engagement portions 620 has a trapezoidal cross-section. A pair of side edges extending so as not to be parallel with each other in each of the engagement portions 620 are designed to have an inclination angle identical with an inclination angle of the inclined surface 325*f* of each of the recesses 325*d* (see FIG. 12).

Figure 15:
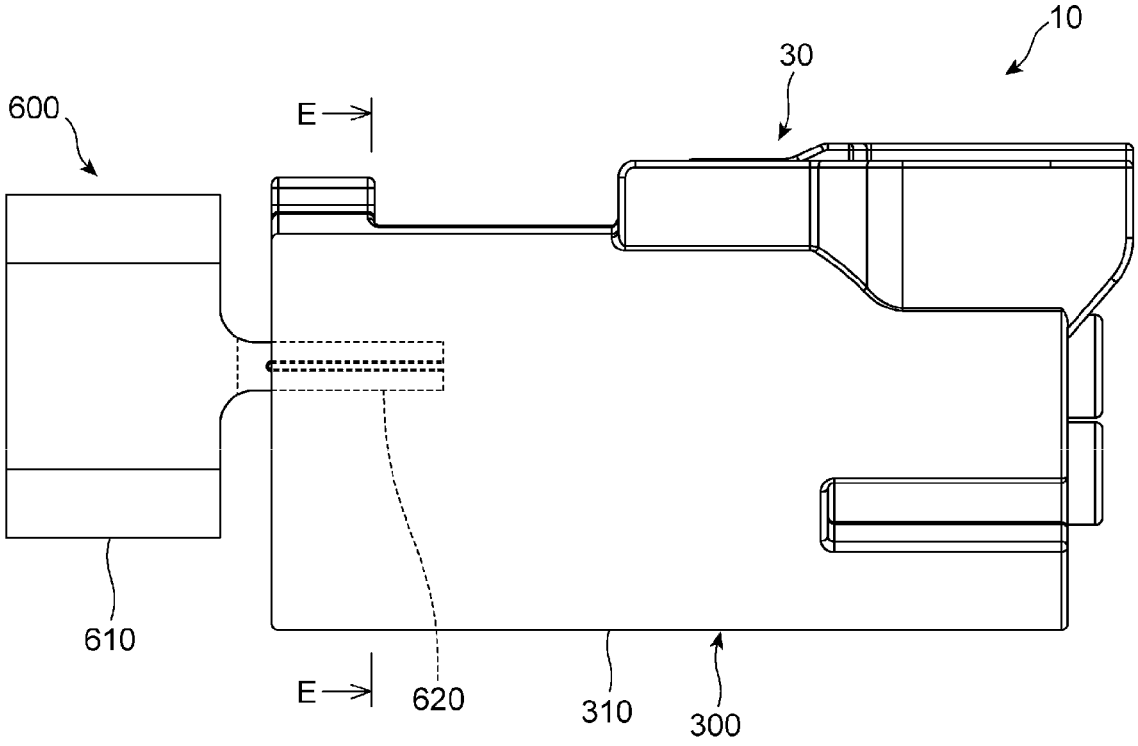
FIG. 15 is a side view showing that the jig illustrated in FIG. 14 is inserted into the electric connector.
Figure 16:
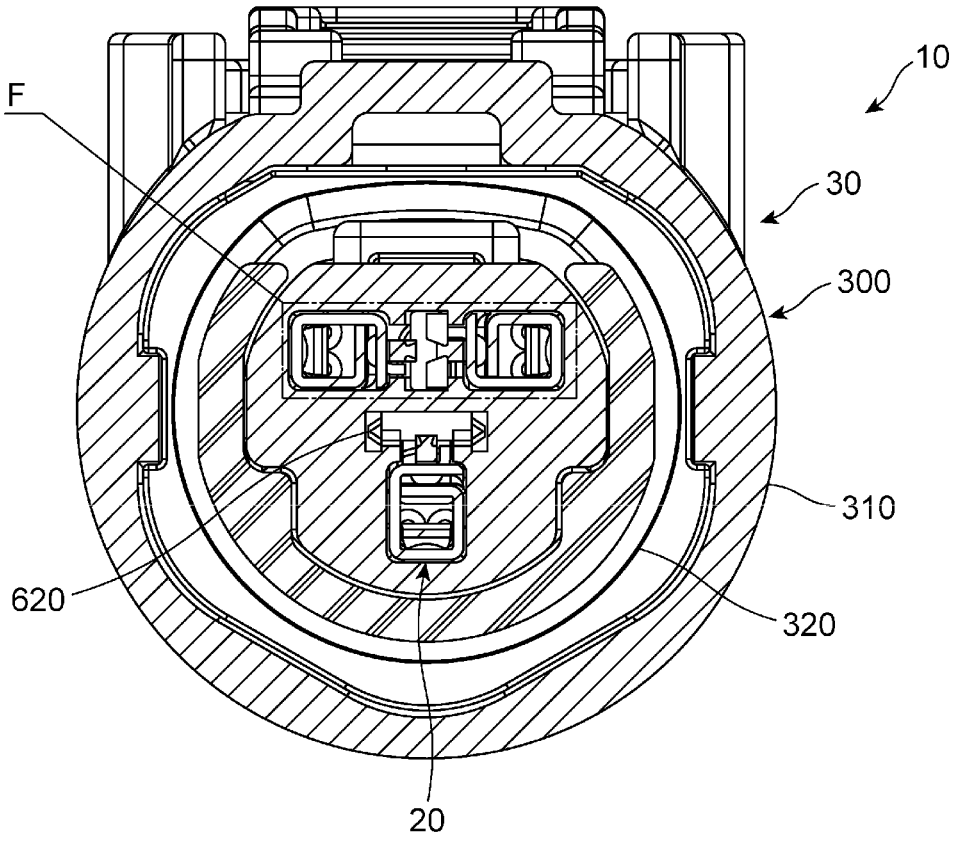
FIG. 16 is a cross-sectional view taken along the line E-E shown in FIG. 15.

As illustrated in FIGS. 5 and 15, after the rear holder 500 was pulled out of the housing 30, a user inserts the engaging portions 620 of the jig 600 into the housing 30 through a front (an opening) of the escape space S. The engaging portions 620 are inserted into the housing 30 such that the engaging portions 620 sandwich the protrusion (raised portion) 325*e* therebetween. Then, the engaging portions 620 are caused to move along the recesses 325*d* in a direction in which the jig 600 is inserted into the housing 30.

After the engaging portions 620 of the jig 600 arrived at distal ends of the recesses 325*d* in a direction in which the jig 600 is inserted into the housing 30, the engaging portions 620 of the jig 600 are caused to move in a direction in which the female terminal 20 is disengaged from the housing 30 (that is, the engaging portions 620 are caused to move towards the escape space 5).

Figure 17:
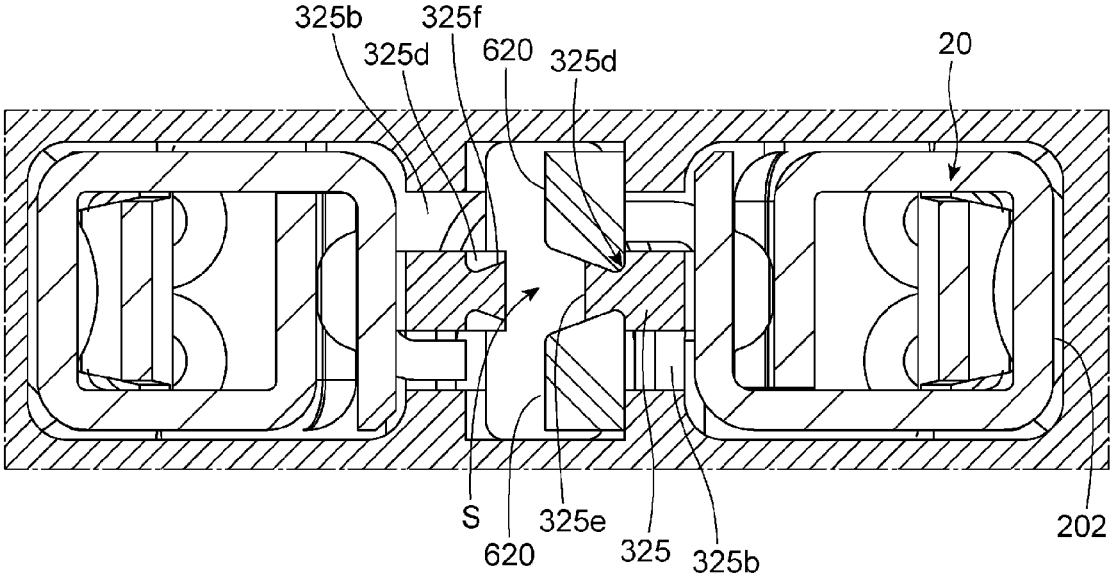
FIG. 17 is an enlarged view of the part F shown in FIG. 16.

As illustrated in FIGS. 8 and 17, when the engaging portions 620 are pushed, keeping in contact with the recesses 325*d*, in a direction in which the female terminal 20 is pulled out of the housing 30, the movable portion 325*c* is bent into the escape space S, since the fixed portions 325*a* are fixed at opposite ends of the lance 323. Thus, the flexible portion 325 is arcuately bent to thereby allow the protrusion 324 to be disengaged from the first stepped portion 202*a*, ensuring that the female terminal 20 can be pulled out of the housing 30 by backwardly pulling the cable C.

Figure 19:
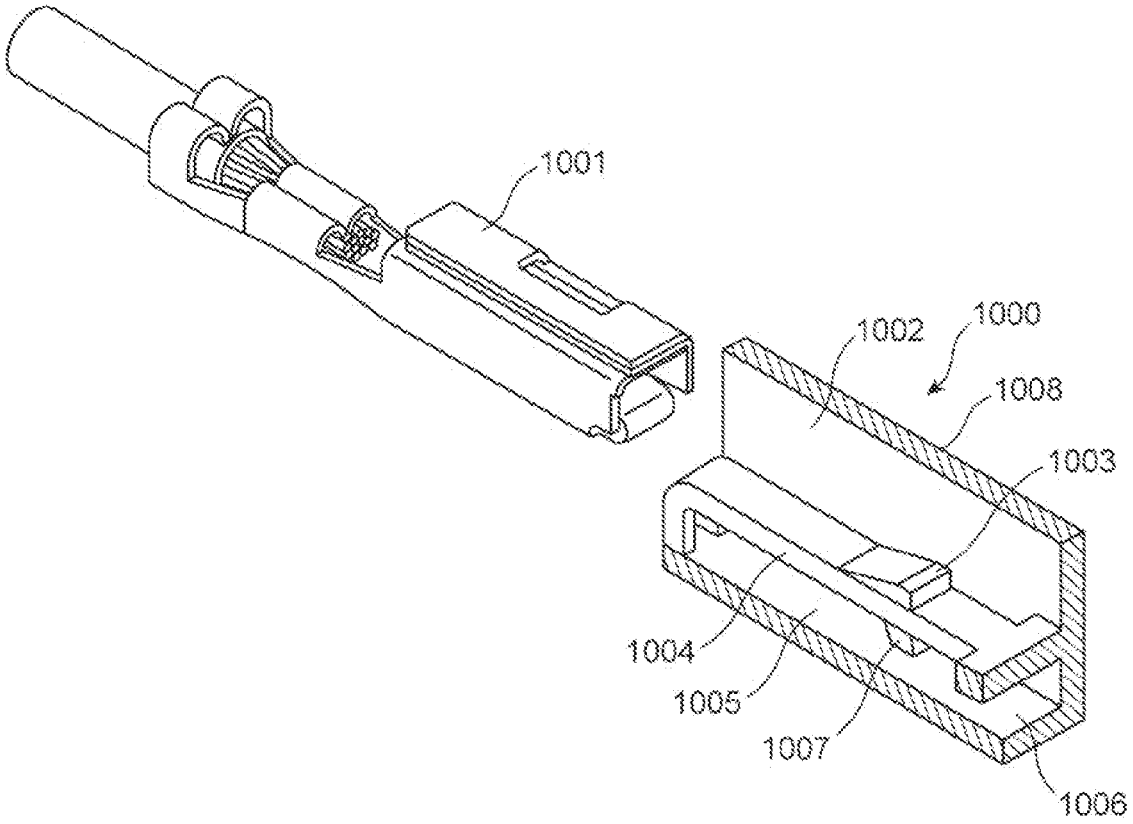
FIG. 19 Prior Art
FIG. 19 is a perspective view of the conventional connector housing.
Figure 20:
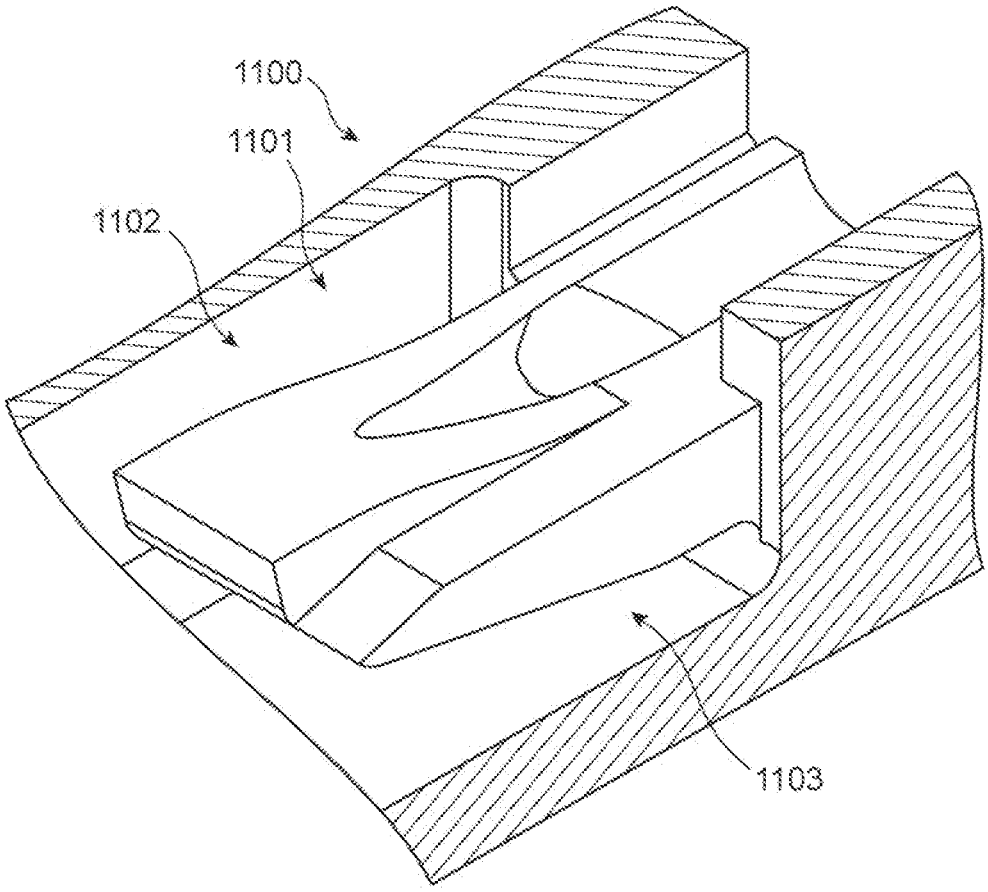
FIG. 20 Prior Art
FIG. 20 is a perspective view of the conventional connector.

As explained so far, the flexible portion 325 bent into the escape space S when the female terminal 20 is disengaged from the housing 30 is formed with the recesses 325*d* extending in a direction in which the jig 600 is inserted into the housing 30. Consequently, it is possible to cause the jig 600 to be engaged to the flexible portion 325 without increase in an entire height of the lance 323 (that is, a length from the protrusion 325*e* to the protrusion 324). Accordingly, since a space required to the housing 30 as the escape space S is just a space in which the flexible portion 325 is able to deform so as to disengage from the protrusion 324, resulting in that, in comparison with the conventional connector housing 1000 illustrated in FIG. 19, it is no longer necessary to have a space in which the protrusion 1007 can move. Thus, the housing 30 can be surely disengaged from the female terminal 20 through the use of the jig 600, and further, can be down-sized.

Since the recesses 325*d* are formed at the opposite sidewalls 325*g* of the flexible portion 325 to extend in a direction in which the jig 600 is inserted into the housing 30, the engaging portions 620 of the jig 600 are able to be arranged along the recesses 325*d* when inserted into the housing 30. Furthermore, since the recesses 325*d* are formed along the opposite sidewalls 325*g* of the flexible portion 325, the recesses 325*d* can be designed to have a length sufficient to cover the jig 600.

The recesses 325*d* are formed at the opposite sidewalls 325*g* of the flexible portion 325 to thereby form the protrusion 325*e* which is to be sandwiched between a pair of the engaging portions 620 extending from the handle 610 of the jig 600. Thus, the engaging portions 620 can be uniformly engaged to the recesses 325*d* formed at the opposite sidewalls 325*g* of the flexible portion 325. Hence, it is possible to cause the flexible portion 325 to be readily bent into the escape space S by moving the jig 600 in a direction in which the female terminal 20 is disengaged from the housing 30.

As mentioned above, each of the recesses 325*d* is designed to be tapered. Specifically, each of the recesses 325*d* has the inclined surface 325*f* formed shallower towards the opposing protrusion 325*e* or in a direction in which the jig 600 disengages the female terminal 20 and the housing 30 from each other. Thus, a wall located in the direction can be formed thick, and so the wall on which a stress acts when the jig 600 moves in the direction can have an enhanced strength.

Furthermore, since the recesses 325*d* extends to the protrusions 324, the jig 600 can reach the protrusions 324 when the jig 600 is inserted into the recesses 325*d*. Accordingly, when the jig 600 is caused to move in a direction in which the female terminal 20 is disengaged from the housing 30, the jig 600 is slightly moved in accordance with the principle of a lever in which an entrance of the escape space S acts as a fulcrum, and distal ends of the engaging portions 620 act as an application point. Thus, it is possible to readily release the engagement of the protrusion 324 to the female terminal 20 through the use of the jig 600.

As illustrated in FIG. 10, since the recesses 325*d* are formed by chipping the flexible portion 325, resulting in that a strength of the flexible portion 325 may be reduced. However, since the flexible portion 325 is designed to have a constant thickness from an end to the other end in the direction in which the female terminal 20 is pulled out of the housing 30, it is possible to avoid reduction of a strength of the flexible portion 325.

Figure 18:
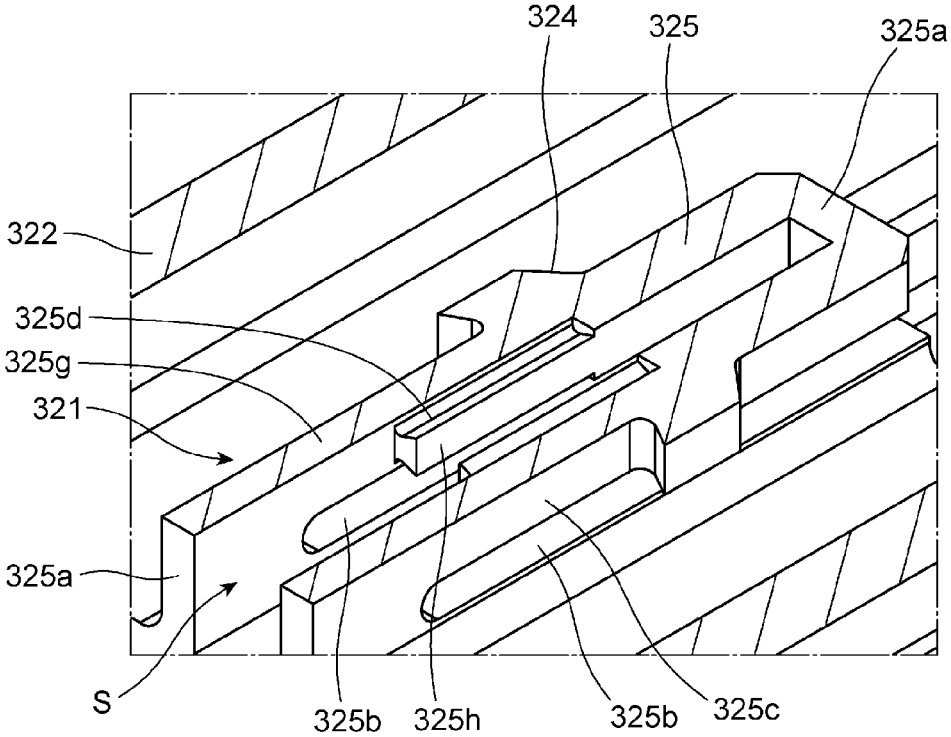
FIG. 18 is an enlarged view of a variation of the lance of the electric connector illustrated in FIG. 10.

As illustrated in FIG. 10, the recesses 325*d* in the present embodiment are designed to extend from a front end of the flexible portion 325 to the protrusion 324. As an alternative as illustrated in FIG. 18, the recesses 325*d* and hence the protrusion 325*h* may be designed to extend to the protrusion 324 from a location away from a front end of the flexible portion 325. The protrusion 324 can be disengaged from the female terminal 20 by causing the engaging portions 620 of the jig 600 to be engaged to the protrusion 325*h*.

Since the flexible portion 325 acts also as a wall of the terminal space 321 into which the female terminal 20 is inserted, it is not necessary to newly form a wall of the terminal space 321. Accordingly, the housing 30 can be further down-sized.

The electric connector 10 in accordance with the present embodiment is designed to include the recesses 325*d* formed at opposite sidewalls of the flexible portion and extending in a direction in which the jig 600 is inserted into the housing 30. As an alternative, the electric connector 10 may be designed to include, in place of the recesses 325*d*, through-holes extending in a direction in which the jig 600 is inserted into the housing 30, in which case, the engaging portions 620 of the jig 600 are designed to be needle-shaped to be able to be inserted to the through-holes.

INDUSTRIAL APPLICABILITY

The electric connector in accordance with the present invention is suitable to be an electric connector used broadly in various fields such as the automobile industry, electric and electronic device industries, and the machinery industry, as a wire connector for transmission of electric signals.

While the present invention has been described in connection with certain preferred embodiments, it is to be understood that the subject matter encompassed by the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2013-119119 filed on Jun. 5, 2013 including specification, claims, drawings and summary is incorporated herein by reference in its entirety.

What is claimed is:

1. A housing used for an electric connector, comprising:

at least one terminal space into which an electric terminal is to be inserted; and a lance for preventing said electric terminal from slipping out of said terminal space, said lance including a flexible portion, a protrusion extending from said flexible portion and engaging with said electric terminal, and a raised portion formed on each of opposing sidewalls of said flexible portion;

said lance defining an escape space in which said flexible portion can be bent in a direction in which said protrusion and said electric terminal are disengaged with each other, said flexible portion having a passage along which a jig can move and which extends in a direction in which said jig is inserted into said lance, said jig being used for disengaging said protrusion and said electric terminal from each, and said passage of said flexible portion comprising a recess in said raised portion on at least one of said opposing sidewalls; and wherein said recess has an inclined surface having a depth shallower in a direction in which said jig moves said flexible portion to disengage said protrusion and said electric terminal from each other.

2. The housing used for an electric connector as set forth in claim 1, wherein said passage is formed between said opposing sidewalls of said flexible portion, and said opposing sidewalls being configured such that said raised portion formed on each of said opposing sidewalls extends into said escape space.

3. The housing used for an electric connector as set forth in claim 1, wherein said recess is formed in said raised portion on each of said opposing sidewalls.

4. The housing used for an electric connector as set forth in claim 3, wherein said recess is formed in said raised portion at edges of said opposite sidewalls.

5. The housing used for an electric connector as set forth in claim 1, wherein said recess is formed by chipping said opposing sidewalls of said flexible portion.

6. The housing used for an electric connector as set forth in claim 1, wherein said flexible portion of said lance is a first flexible portion of two flexible portions extending in parallel with each other, said protrusion is a first protrusion of two protrusions extending outwardly from a respective one of said two flexible portions, and said escape space is defined between said two flexible portions.

7. The housing used for an electric connector as set forth in claim 1, wherein said raised portion on each of said opposing sidewalls is configured such that a pair of engaging portions formed at a distal end of said jig sandwiches said raised portion therebetween.

8. The housing used for an electric connector as set forth in claim 1, wherein said recess extends along said flexible portion from a distal end of said flexible portion to said protrusion extending from said flexible portion.

9. The housing used for an electric connector as set forth in claim 1, wherein said recess extends along said flexible portion from a location spaced apart from a distal end of said flexible portion to said protrusion extending from said flexible portion.

10. The housing used for an electric connector as set forth in claim 1, wherein said flexible portion has a constant thickness from a first end to a second end in a direction in which said jig moves said flexible portion so as to disengage said protrusion and said electric terminal from each other.

11. The housing used for an electric connector as set forth in claim 1, wherein said flexible portion is defined by a wall of said terminal space.

12. The housing used for an electric connector as set forth in claim 1, wherein said passage comprises a through-hole.

* * * * *